US008452217B2

(12) United States Patent
Sato et al.

(10) Patent No.: US 8,452,217 B2
(45) Date of Patent: May 28, 2013

(54) TONER SUPPLY AND CLEANING ROLLER COMPRISING ELECTROCONDUCTIVE ELASTIC LAYER SUPPORTED BY MEANS OF ADHESIVE LAYER AND IMAGE FORMING APPARATUS USING THE SAME

(75) Inventors: Junichiro Sato, Yokohama (JP); Satoru Kusano, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 294 days.

(21) Appl. No.: 12/742,968

(22) PCT Filed: Aug. 29, 2008

(86) PCT No.: PCT/JP2008/065536

§ 371 (c)(1),
(2), (4) Date: Jul. 29, 2010

(87) PCT Pub. No.: WO2009/063678

PCT Pub. Date: May 22, 2009

(65) Prior Publication Data

US 2010/0290821 A1 Nov. 18, 2010

(30) Foreign Application Priority Data

Nov. 15, 2007 (JP) ..... 2007-296782

(51) Int. Cl.
*G03G 15/09* (2006.01)

(52) U.S. Cl.
USPC ..... 399/272; 399/281; 399/286

(58) Field of Classification Search
USPC ..... 399/272, 281, 286
See application file for complete search history.

(56) References Cited

U.S. PATENT DOCUMENTS

| | | | |
|---|---|---|---|
| 5,246,762 | A * | 9/1993 | Nakamura |
| 5,834,116 | A | 11/1998 | Sawa et al. |
| 2001/0003757 | A1 | 6/2001 | Sakata et al. |
| 2001/0036376 | A1 | 11/2001 | Yamazaki et al. |
| 2003/0157369 | A1 | 8/2003 | Yoshikawa et al. |

FOREIGN PATENT DOCUMENTS

| | | | |
|---|---|---|---|
| JP | 11-231654 | A | 8/1999 |
| JP | 2001-173640 | A | 6/2001 |
| JP | 2001-281982 | A | 10/2001 |
| JP | 2001-341139 | A | 12/2001 |

(Continued)

OTHER PUBLICATIONS

International Search Report dated Sep. 2, 2008 (2 pates.

(Continued)

*Primary Examiner* — David Gray
*Assistant Examiner* — Laura Roth
(74) *Attorney, Agent, or Firm* — Sughrue Mion, PLLC

(57) ABSTRACT

The invention provides a toner supply and cleaning roller that secures sufficient density especially at an initial stage of printing, and an image forming apparatus using the same.
The toner supply and cleaning roller has a shaft (1) and an electroconductive elastic layer (3) made of a urethane foam and supported on the circumference of the shaft (1) by means of an adhesive layer (2) in between. The resistance of the roller at an applied voltage of 100 V is $10^5\Omega$ or lower, preferably $10^{4.5}\Omega$ or lower, and the resistance of the roller at an applied voltage of 5 V is $10^6$ to $10^8\Omega$. The adhesive layer (2) contains a hot-melting polymeric adhesive and is formed preferably at a temperature not exceeding the melting point of the hot-melting polymeric adhesive.

6 Claims, 3 Drawing Sheets

FOREIGN PATENT DOCUMENTS

| | | | | |
|---|---|---|---|---|
| JP | 2001-356585 | A | | 12/2001 |
| JP | 2002-053639 | A | | 2/2002 |
| JP | 2003-215905 | A | | 7/2003 |
| JP | 2003-342481 | A | | 12/2003 |
| JP | 2004-317541 | A | | 11/2004 |
| JP | 2004317541 | A | * | 11/2004 |
| JP | 2006-323402 | A | | 11/2006 |

OTHER PUBLICATIONS

Extended European Search Report issued Dec. 16, 2011 for European Patent Application No. 08849138.6.

* cited by examiner

TONER SUPPLY AND CLEANING ROLLER COMPRISING ELECTROCONDUCTIVE ELASTIC LAYER SUPPORTED BY MEANS OF ADHESIVE LAYER AND IMAGE FORMING APPARATUS USING THE SAME

TECHNICAL FIELD

The present invention relates to a toner transfer roller (hereinafter occasionally referred to simply as "roller") and an image forming apparatus using the same; more particularly relates to a toner transfer roller to be used in an image forming apparatus, such as a copying machine and a printer, for supplying a toner (a developer) to a developing roller, which transfers the toner to an image forming medium, such as a photosensitive drum and paper, to form a visible image on the surface thereof, and an image forming apparatus using the same.

BACKGROUND ART

Generally, as shown in FIG. 5, in a developing section of an image forming apparatus according to an electrophotographic method, such as a copying machine and a printer, are provided an image forming medium 11, such as a photosensitive drum retaining an electrostatic latent image, a developing roller 12 which touches the image forming medium 11 to adhere a toner 20 carried on the surface thereto to convert the electrostatic latent image to a visible image, and a toner transfer roller 13' (including a toner supplying roller and a cleaning roller for scraping off unnecessary toner) for supplying the toner to the developing roller 12, so that the toner 20 is transferred according to a continuous process from a toner storing section 14 through the toner transfer roller 13' and the developing roller 12 to the image forming medium 11 to form an image. In FIG. 5, the reference number 15 denotes a transcribing roller, the reference number 16 a charging section, the reference number 17 an exposing section, and the reference number 18 a blade for scraping the toner.

The toner transfer roller is so constituted that an electroconductive elastic material is supported on the circumference of a shaft by means of an adhesive layer in between, in order to protect the developing roller against damages by contact, and to ensure gripping by increasing the contact areas between the rollers. Conventionally, an adhesive with a relatively low melting point as low as 110° C. or less has been utilized for bonding the shaft and the electroconductive elastic material, in order not to damage the electroconductive elastic material by the heat required for bonding.

The mechanism for transferring the toner 20 from the toner transfer roller 13 to the developing roller 12 in the developing system is described in FIG. 6. With respect to the positively (or negatively) charged toner 20, the surface of the toner transfer roller 13 is charged negatively (or positively) by friction with the toner 20 and the developing roller 12. The amount of the charge on the roller surface of the charged toner transfer roller 13 can be controlled by releasing the charge through a shaft 1 containing a metal core. In this case, if the amount of the charge on the surface of the toner transfer roller is limited, the toner sticks to the roller surface less intensively, and, as a result, the amount of the transferred toner can be increased. The term toner transfer roller as used in this Application includes a toner supplying roller and a cleaning roller for scraping off unnecessary toner. That is, it refers to a toner supply and cleaning roller.

Conventionally, the electroconductivity of a toner transferring roller used in a toner cartridge for a laser beam printer (LBP), etc. is required to be set about $10^3$ to $10^8\Omega$ in terms of the roller resistance at an applied voltage of 100 V in order to control the toner electrostatically as described above. For this purpose, the electroconductive property of the roller has been controlled conventionally mainly by adding an electroconductive filler or an antistatic agent into the electroconductive elastic material. Furthermore, for example, Patent Document 1 discloses a technology, in which a roller is constituted by placing an inner electroconductive layer and an electroconductive elastic layer successively around the circumference of a shaft, and by making the electric resistance in the thickness direction of the inner electroconductive layer higher, for the purpose of providing an electroconductive roller whose electroconductive property can be easily controlled, enabling easy production of a roller with low electroconductivity.

Patent Document 1: Japanese Unexamined Patent Application Publication No. 4-256985 (Claims, etc.)

DISCLOSURE OF THE INVENTION

Problems to be Solved by the Invention

Although the roller resistance at an applied voltage of 100 V was easily controlled by the conventional method for changing the roller electroconductivity by a composition of an electroconductive elastic material, the control of this condition was not enough to obtain sufficient density at an initial stage of printing.

Consequently, an object of the present invention is, solving the above described problem, to provide a toner transfer roller that secures sufficient density especially at an initial stage of printing, and an image forming apparatus using the same.

Means for Solving the Problems

The present inventors have studied intensively focusing on the controlling mechanism with respect to the amount of the charge on the roller to achieve the above-mentioned object to find that it is effective to control the voltage dependence for the sake of increasing the density at an initial stage of the printing endurance, so that the roller resistance at a low applied voltage, particularly at an applied voltage of 5 V, becomes $10^6$ to $10^8\Omega$. More specifically, it has been found that, instead of a conventional method of changing the electroconductive elastic material, by modification of the adhesive layer existing between the electroconductive elastic layer and the shaft, the density at an initial stage of printing can be secured without causing inconvenience during mass production.

In controlling the transfer of the toner, a voltage of several hundred V is applied between a toner transfer roller and ground to transfer the charge on the toner to the roller surface and the amount of which is controlled by discharging the roller surface through the electroconductive elastic material, the adhesive layer and the shaft to ground, so that the toner can be easily released to increase the transfer amount of the toner. At such condition is required a toner transfer roller with a low resistance of $10^5\Omega$ or less, preferably $10^{4.5}\Omega$ or less, at an applied voltage of 100 V, which is close to the voltage difference with ground. However, at an initial stage of printing, the toner is charged very easily and consequently usually charged excessively. In such case the toner cannot be released sufficiently even by the aforesaid mechanism and the transfer amount of the toner at an initial stage of printing is limited.

As a result, in addition to a conventional concept of increasing the transfer amount of the toner by decreasing the electrical charge on the toner, the present inventors have devised a method of further increasing the transfer amount of the toner by transferring the toner from the toner transfer roller to the developing roller by means of a Coulomb force taking advantage of slight voltage differences among the toner transfer roller, the toner and the developing roller. Namely, the toner transfer roller and the developing roller are generally connected with the same electrical source and are substantially at the same potential, but precisely, by designing the toner transfer roller to have a voltage dependent resistance, there can be a voltage difference as small as several V between the toner transfer roller and the developing roller. More particularly, the resistance of the toner transfer roller, in the range of several hundred V envisioning a circuit between the same and ground, is set at $10^5\Omega$ or lower, more preferably $10^{4.5}\Omega$ or lower as required conventionally, and in the low voltage range of several V, typically 5 V, envisioning a circuit between the same and the developing roller, is set between $10^6$ and $10^8\Omega$, so that, while utilizing the conventional controlling mechanism by decreasing the amount of charge on the toner, by generating slight voltage difference between the toner transfer roller and the developing roller, a repulsive force between the toner and the toner transfer roller, and an attractive force between the toner and the developing roller are exercised by Coulomb forces, making it possible to increase the transfer amount of the toner and to ensure sufficient image density even at an initial stage of printing.

To make the roller resistance of the toner transfer roller voltage dependent, there are two methods: a method by which the adhesive layer is made dielectric and the thickness thereof is controlled for designing the voltage dependence, and a method by which an electroconductive substance is mixed into a dielectric elastic material to form an electroconductive elastic layer and simultaneously design voltage dependence. Concerning the former method of controlling the thickness of the dielectric adhesive layer, there are a method by which the thickness of the adhesive layer itself is changed, and a method by which, using a hot-melting adhesive, the bonding temperature is controlled to control the permeation of the adhesive layer into the electroconductive elastic layer to control indirectly the thickness of the adhesive layer. Concerning the latter method, there is a method by which the particle shape and the amount of the mixed electroconductive substance are appropriately selected to design the voltage dependence of the resistance.

The present inventors have known from the standpoint of easiness in control, that, out of the above methods, the former method of controlling the thickness of the dielectric adhesive layer, especially the method by which the voltage dependence of the resistance of the toner transfer roller is designed by controlling the bonding temperature, is effective in designing stably the voltage dependence of the roller resistance, thereby completing the present invention.

More particularly, in case a hot-melting adhesive is treated for bonding a shaft and an electroconductive elastic layer forming an adhesive layer at a temperature not lower than the melting point of the adhesive similarly to a conventional method, the molten adhesive is believed to permeate substantially into a foamed electroconductive elastic layer, and the voltage dependence of the roller resistance is small. Meanwhile, incase a hot-melting adhesive is treated for bonding a shaft and an electroconductive elastic layer forming an adhesive layer at a temperature below the melting point of the adhesive but high enough for the adhesive to be softened and secure adequate bond strength, the semi-molten adhesive does not permeate into a foam, and the resistance of $10^6$ to $10^8\Omega$ at an applied voltage of 5 V can be attained.

As described above, a toner transfer roller of the present invention comprises a shaft and an electroconductive elastic layer made of a urethane foam and supported on the circumference of the shaft by means of an adhesive layer in between, wherein the resistance of the roller at an applied voltage of 100 V is $10^5\Omega$ or lower, especially $10^{4.5}\Omega$ or lower, and the resistance of the roller at an applied voltage of 5 V is $10^6$ to $10^8\Omega$.

According to the present invention, the adhesive layer is preferably constituted of a hot-melting polymeric adhesive and is formed at a temperature not exceeding the melting point of the hot-melting polymeric adhesive. Further, for the roller of the present invention to attain the resistance values, and considering the compatibility with the elastic layer and the bond strength therefrom, as well as the mass-productivity, the hot-melting polymeric adhesive preferably contains as a main component an adipate based polyurethane resin with the melting point of 120° C. or higher. According to the above, the adhesive can be adequately softened to secure bond strength and sufficient thickness of the adhesive layer at a temperature below the melting point of the adhesive, thus the roller resistance of $10^6$ to $10^8\Omega$ can be stably attained at a low voltage region.

Further, an image forming apparatus of the present invention is equipped with the toner transfer roller according to the present invention.

Advantages of the Invention

Owing to the aforedescribed constitution, the present invention can provide a toner transfer roller and an image forming apparatus using the same which can secure sufficient density especially at an initial stage of printing.

DESCRIPTION OF SYMBOLS

| Description of Symbols |
|---|
| 1: SHAFT |
| 2: ADHESIVE LAYER |
| 3: ELECTROCONDUCTIVE ELASTIC LAYER |
| 11: IMAGE FORMING MEDIUM |
| 12: DEVELOPING ROLLER |
| 13: TONER SUPPLY AND CLEANING ROLLER |
| 14: TONER STORING SECTION |
| 15: TRANSCRIBING ROLLER |
| 16: CHARGING SECTION |
| 17: EXPOSING SECTION |
| 18: BLADE |

-continued

| Description of Symbols |
|---|
| 20: TONER |
| 100: METAL PLATE |

BEST MODE FOR CARRYING OUT THE INVENTION

Preferred embodiments of the present invention will be described below in more detail with reference to the accompanying drawings.

Figure 1:
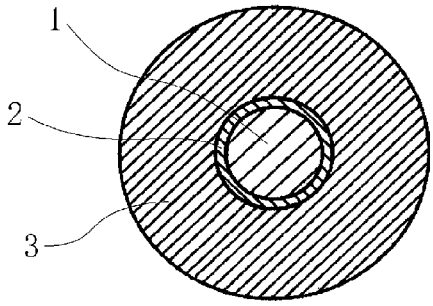
FIG. 1 is a transverse sectional view of a toner transfer roller according to an embodiment of the present invention.

A transverse sectional view of a toner transfer roller according to a preferred embodiment of the present invention is shown in FIG. 1. As obvious from the figure, a toner transfer roller according to the present invention is so constituted that on the circumference of the shaft 1 is supported the electroconductive elastic layer 3 by means of the adhesive layer 2 in between.

The toner transfer roller according to the present invention requires that the roller resistance at an applied voltage of 100 V is $10^5\Omega$ or lower and the roller resistance at an applied voltage of 5 V is $10^6$ to $10^8\Omega$. With such voltage dependence, the density at an initial stage of printing can be secured at the same level as at a latter half of the printing endurance, thereby successfully solving the problem that sufficient density cannot be obtained at an initial stage of printing.

The electroconductive elastic layer 3 is made of a urethane foam. It is preferable that the electroconductive elastic layer 3 is made of a water-foamed polyurethane foam containing a carbon black as an electroconductive additive, or a polyurethane foam dipped in an electroconductive coating material to impart electroconductivity, and that the adhesive layer 2 is made of a hot-melting polymeric adhesive, and among others made of an adhesive containing as a main component an adipate based polyurethane resin with the melting point of 120° C. or higher. It is especially preferable that an adhesive having a higher melting point than conventional adhesives and especially that containing as a main component an adipate based polyurethane resin is used as a constituent material of the adhesive layer.

This is presumably attributable to the following reason. Namely, as described above, in case of an adhesive with a low melting point the molten adhesive becomes substantially permeated in an electroconductive elastic layer, when a shaft and the electroconductive elastic layer are bonded. On the contrary, in case an adhesive with a high melting point is used according to the present invention, the adhesive does not melt completely during bonding and remains to certain extent in a solid state forming a thick film on the circumference of the shaft in a completed roller. The thick film adhesive layer 2 impedes a flow of charge under a condition of low voltage application allowing appropriate distribution of the charge amount on a charged roller surface to generate an appropriate voltage difference toward a developing roller. This enables the adsorbed toner to transfer smoothly to the developing roller, and consequently even at an initial stage of printing, when the toner is charged easily, the toner can be released appropriately increasing the transfer amount of the same to secure sufficient density. Therefore, according to the present invention, advantageous results shown in the following Table 1 can be obtained in contrast to a conventional roller with the roller resistance at an applied voltage of 5 V of $10^6\Omega$ or lower.

TABLE 1

| | | Conventional roller | Roller of the present invention |
|---|---|---|---|
| Initial stage | Roller resistance (5 V applied) | $10^6\ \Omega$ or less | $10^6\ \Omega$-$10^8\ \Omega$ |
| | Melting state of adhesive layer | Molten | Semi-molten |
| | Charge amount on roller surface | Light | Heavy |
| | Toner amount on roller surface | Light | Heavy |
| | Image density | Low | High |
| Latter stage | Toner amount on roller surface | Heavy | Heavy |
| | Image density | High | High |
| | Toner consumption | Heavy | Light |

Due to the reason described above, the temperature for melting the adhesive, namely the heating temperature of the shaft and the electroconductive elastic layer during bonding is also important according to the present invention. More specifically, the heating temperature during bonding is required to be 100° C. or higher. During heating for bonding, the adhesive melts, and moreover the electroconductive elastic layer made of a urethane foam is presumably modified by a chemical reaction with the adhesive. However, if the heating temperature is below 100° C., the adhesive melts insufficiently, or the modification of the electroconductive elastic layer is insufficient, and chemical bonding between the electroconductive elastic layer and the adhesive layer is not promoted and sufficient bonding cannot be attained. In case the heating temperature reaches 100° C., bonding can be secured by prolonged (e.g. about 8 hours) heating, however, considering productivity and for the sake of stable modification, the heating temperature of 120° C. or higher, and especially 130° C. or higher is preferable. In case the heating temperature exceeds 200° C., such problems would occur as deterioration or burning of the electroconductive elastic layer made of a urethane foam. Consequently, the heating temperature is more preferably between 130° C. and 200° C.

Further, from the similar reason, the melting point of the adhesive is preferably between 130° C. and 200° C. Furthermore, concerning the relationship between the melting point of the adhesive and the heating temperature, more preferable conditions are that the heating temperature should be between 130° C. and 200° C., and an adhesive with the melting point higher than the heating temperature and within the range between 130° C. and 200° C. should be used. If the melting point of the adhesive is not exceeding the heating temperature, the adhesive melts completely and intended advantages of the present invention cannot be obtained.

An attempt to bond an adhesive having the melting point of 120° C. or lower at a lower melting point would fail in bonding due to the heat-retention property of the foam itself. Further, a layer of the adhesive is hardly formed as intended, and moreover any adhesive layer substantially disappears during use in a usage environment by heat generation from electrical power or mechanical shear, failing to yield advantageous results.

According to the present invention, there is no particular restriction to attain the expected advantages of the present invention, insofar as the aforedescribed conditions concerning the adhesive layer are satisfied, and other particulars, such as a detailed constitution of the roller, and a specific roller resistance value, may be determined appropriately according to needs.

For example, insofar as an adhesive to be used for the adhesive layer 2 is a hot-melting polymeric adhesive, there is no particular restriction on other components. It may be in any form, such as a film or pellets. The thickness of the adhesive layer 2 is preferably 20 to 300 μm. In case it is too thin, bonding failure should take place, and in case it is too thick, a preferable roller resistance should not be obtained. Neither of the cases are favorable.

There is no particular restriction on the shaft 1 to be used for the roller according to the present invention, and any type may be used. For example, any of metallic shafts among a steel product, such as a sulfur free-cutting steel, plated with nickel, zinc, etc.; a metal core made of a solid metal, such as iron, stainless steel and aluminum; and a metallic cylinder with a bored internal hole; may be used.

Further, there is no particular restriction on a material for the urethane foam to be used for the electroconductive elastic layer 3, insofar as it is a resin containing a urethane bond. Practical examples thereof are described below.

A water foaming method can be used for producing a urethane foam. More specifically, according to a known method, foam forming materials including a prepolymer prepared in advance by reacting an isocyanate component and a polyol component, water, a urethane reaction catalyst, etc. are allowed freely to expand to a pre-determined block form, which is then heat-cured.

Examples of a polyol component to be used for producing the prepolymer include a polyether polyol prepared by addition polymerization of ethylene oxide and propylene oxide, a polytetramethylene ether glycol, a polyester polyol prepared by condensation of an acid component and a glycol component, a polyester polyol prepared by ring-opening polymerization of caprolactone, and a polycarbonate diol.

Examples of a polyether polyol prepared by addition polymerization of ethylene oxide and propylene oxide include those prepared by addition polymerization of ethylene oxide and propylene oxide with a starting material, such as water, propylene glycol, ethylene glycol, glycerol, trimethylolpropane, hexanetriol, triethanolamine, diglycerol, pentaerythritol, ethylenediamine, methyl glucocide, an aromatic diamine, sorbitol, sucrose, and phosphoric acid; and those using water, propylene glycol, ethylene glycol, glycerol, trimethylolpropane, and hexanetriol as starting materials are especially preferable. With respect to the contents of ethylene oxide and propylene oxide for addition or a microstructure, the content of ethylene oxide is preferably 2 to 95% by weight, more preferably 5 to 90% by weight, and termini are preferably added with ethylene oxide. Further, a sequence of ethylene oxide and propylene oxide in a molecular chain is preferably random.

With respect to the molecular weight of a polyether polyol, for bi-functional molecules from such a starting material, as water, propylene glycol and ethylene glycol, the weight average molecular weight is preferably in the range of 300 to 6,000, and more preferably in the range of 3,000 to 5,000. For tri-functional molecules from such a starting material, as glycerol, trimethylolpropane, and hexanetriol, the weight average molecular weight is preferably in the range of 900 to 9,000, and more preferably in the range of 4,000 to 8,000. Furthermore, a bi-functional polyol and a tri-functional polyol may be blended appropriately and used.

A polytetramethylene ether glycol may be, for example, prepared by a cationic polymerization of tetrahydrofuran. The weight average molecular weight thereof is preferably in the range of 400 to 4,000 for use, and especially preferably in the range of 650 to 3,000. Further, polytetramethylene ether glycols having different molecular weights may be blended preferably. Furthermore, a polytetramethylene ether glycol yielded by copolymerization of alkylene oxides, such as ethylene oxide and propylene oxide, may be also used.

Furthermore, it is also preferable to blend for use a polytetramethylene ether glycol and a polyether polyol prepared by addition polymerization of ethylene oxide and propylene oxide. In this case, the blend ratio thereof is preferably in the range of 95:5 to 20:80, especially preferably in the range of 90:10 to 50:50.

Further, the polyol component may be used in combination with a polymer polyol obtained by modifying a polyol with acrylonitrile, a polyol obtained by adding melamine to a polyol, a diol such as butanediol, a polyol such as trimethylolpropane, or a derivative thereof.

As a polyisocyanate component to be used for preparation of the prepolymer are used an aromatic isocyanate or a derivative thereof, an aliphatic isocyanate or a derivative thereof, and an alicyclic isocyanate or a derivative thereof. Among them is preferable an aromatic isocyanate or a derivative thereof, and tolylene diisocyanate (TDI) or a derivative thereof and diphenylmethane diisocyanate (MDI) or a derivative thereof are used especially favorably.

As tolylene diisocyanate or a derivative thereof are used crude tolylene diisocyanate, 2,4-tolylene diisocyanate, 2,6-tolylene diisocyanate, a mixture of 2,4-tolylene diisocyanate and 2,6-tolylene diisocyanate, and derivatives thereof after a urea modification, a biuret modification, a carbodiimide modification, and a urethane derivative modified by a polyol. As diphenylmethane diisocyanate or a derivative thereof is used, for example, diphenylmethane diisocyanate or a derivative thereof prepared by reacting diaminodiphenylmethane or a derivative thereof with phosgene. Derivatives of diaminodiphenylmethane include a polycyclic derivative, and pure diphenylmethane diisocyanate derived from diaminodiphenylmethane, a polymeric diphenylmethane diisocyanate derived from a polycyclic derivative of diaminodiphenylmethane, etc. can be used. Concerning a functional group number of a polymeric diphenylmethane diisocyanate, usually a mixture of pure diphenylmethane diisocyanate and polymeric diphenylmethane diisocyanates with various functional group numbers is used, and the average functional group number is preferably 2.05 to 4.00, and more preferably 2.50 to 3.50. Further, derivatives to be yielded by modification of these diphenylmethane diisocyanate or a derivative thereof, as exemplified by a urethane derivative modified by a polyol, etc., a dimer by forming uretdione, a derivative of an isocyanurate modification, a derivative of a carbodiimide/uretone-imine modification, a derivative of an allophanate modification, a derivative of a urea modification and a derivative of a biuret modification, can be used. Several types of diphenylmethane diisocyanate and derivatives thereof can be blended and used.

Concerning a preparation method of a prepolymer, a method, by which a polyol and an isocyanate are placed in an appropriate container, stirred adequately, and kept at 30 to 90° C., more preferablely at 40 to 70° C. for 6 to 240 hours, more preferably for 24 to 72 hours, can be exemplified. In this case the mixture ratio of the polyol and the isocyanate should be preferably so adjusted that the isocyanate content in the yielded prepolymer is 4 to 30% by weight, and more preferably 6 to 15% by weight. Incase the isocyanate content is below 4% by weight, the stability of the prepolymer is compromised, and the prepolymer may cure during storage and become unable to be used. In case the isocyanate content exceeds 30% by weight, the content of isocyanate, which is not converted to a prepolymer, increases, and such polyisocyanate cures with a polyol component to be used in a later polyurethane curing reaction according to a similar reaction mechanism as a one-shot process bypassing a prepolymer preparation reaction, and consequently advantages of use of a prepolymer process are diluted.

Into a urethane foam, an electroconductive additive, an foaming agent (water, a low-boiling substance, a gas, etc.), a cross-linking agent, a surfactant, a catalyst, a foam stabilizer, etc. may be added according to need in addition to the polyol component and the isocyanate component, so that a layered structure in accordance with a requirement may be constituted. In this case, a fire retardant, a filler, an electroconductive additive, such as an ionic electroconductive additive and an electronic electroconductive additive, a publicly known filler, cross-linking agent, etc. may be used appropriately.

Examples of an ionic electroconductive additive include ammonium salts, such as perchlorates, chlorates, hydrochlorides, bromates, iodates, fluoroborates, sulfates, alkyl sulfates, carboxylates and sulfonates, of tetraethyl ammonium, tetrabutyl ammonium, dodecyl trimethyl ammonium (e.g. lauryl trimethyl ammonium), hexadecyl trimethyl ammonium, octadecyl trimethyl ammonium (e.g. stearyl trimethyl ammonium), benzyl trimethyl ammonium and modified fatty acid dimethylethyl ammonium; perchlorates, chlorates, hydrochlorides, bromates, iodates, fluoroborates, trifluoromethyl sulfates and sulfonates, of alkali metals or alkaline earth metals, such as lithium, sodium, potassium, calcium and magnesium.

Examples of the electronic electroconductive additive include electroconductive carbon, such as Ketchen black and acetylene black, carbon for rubbers, such as SAF, ISAF, HAF, FEF, GPF, SRF, FT and MT; oxidation-treated carbon for ink; pyrolytic carbon; natural graphite; artificial graphite; electroconductive metal oxides, such as tin oxide, titanium oxide and zinc oxide; and metals, such as nickel, copper, silver and germanium. The electroconductive additives may be used singly or in combination of two or more types. Although there is no particular restriction on the content thereof and it may be selected appropriately according to need, it is usually 0.1 to 40 parts by weight, preferably 0.3 to 20 parts by weight, based on 100 parts by weight of the total amount of a polyol and an isocyanate.

Examples of a catalyst to be used for a curing reaction of a urethane foam include monoamines, such as triethylamine and dimethylcyclohexylamine; diamines, such as tetramethylethylenediamine, tetramethylpropanediamine and tetramethylhexanediamine; triamines, such as pentamethyldiethylenetriamine, pentamethyldipropylenetriamine and tetramethylguanidine; cyclic amines, such as triethylenediamine, dimethylpiperazine, methylethylpiperazine, methylmorpholine, dimethylaminoethylmorpholine and dimethylimidazole; alcoholamines, such as dimethylaminoethanol, dimethylaminoethoxyethanol, trimethylaminoethylethanolamine, methylhydroxyethylpiperazine and hydroxyethylmorpholine; etheramines, such as bis(dimethylaminoethyl)ether and ethylene glycol bis(dimethyl)aminopropyl ether; and organometal compounds, such as stannous octoate, dibutyltin diacetate, dibutyltin dilaurate, dibutyltin mercaptide, dibutyltin thiocarboxylate, dibutyltin dimaleate, dioctyltin mercaptide, dioctyltin thiocarboxylate, phenylmercury propionate and lead octenate. Any of such catalysts may be used singly or in combination of two or more thereof.

According to the present invention, a silicone foam stabilizer or various surfactants are preferably added to raw materials for the urethane foam in order to stabilize cells of the foam product. As the silicone foam stabilizer is used preferably a dimethylpolysiloxane-polyoxyalkylene copolymer, and a copolymer containing a dimethylpolysiloxane segment having a molecular weight of 350 to 15,000 and a polyoxyalkylene segment having a molecular weight of 200 to 4,000 is especially preferable. The molecular structure of the polyoxyalkylene segment is preferably an addition polymer of ethylene oxide or an addition copolymer of ethylene oxide and propylene oxide, and the molecular termini are preferably formed by ethylene oxide. As the surfactant, an ionic surfactant, such as a cationic surfactant, an anionic surfactant and an amphoteric, and a nonionic surfactant, such as various polyethers and various polyesters, can be exemplified. Any of the above may be used singly or in combination of two or more thereof. The amount of the silicone foam stabilizer or surfactants to be added to 100 parts by weight of the total amount of a polyol component and an isocyanate component is preferably 0.1 to 10 parts by weight and more preferably 0.5 to 5 parts by weight.

The electroconductive elastic layer made of a urethane foam according to the present invention has preferably on the surface cell openings that communicate with the inside, so that the toner can be supplied favorably from the inside of the foam, thereby solving a problem of an unstable transportation rate of the toner. Preferably, the diameter of the cell opening is 50 to 400 μm, and the number of the openings per 1 $cm^2$ of the surface of the urethane foam is 100 to 2,000. The production of a urethane foam to yield the structure having such cell openings can be performed according to a conventional technology combining appropriately a polyurethane composition and a mold release agent.

A toner transfer roller according to the present invention can be manufactured by supporting the electroconductive elastic layer 3 on the circumference of the shaft 1 by means of an adhesive in between, followed by heating at a pre-determined temperature as described above. More specifically, first the electroconductive elastic layer 3 made of urethane foam is formed into an optional shape, e.g. into a slab, and the circumference of the shaft 1 is wound with a film-form adhesive, or coated with molten adhesive pellets to form an adhesive film. Then a hole is bored in the electroconductive elastic layer 3, and the shaft 1 with the adhesive is inserted into the hole. By heating at a pre-determined temperature, the shaft 1 and the electroconductive elastic layer 3 are consolidated by means of the adhesive layer 2, the surface of the electroconductive elastic layer 3 is ground to an intended cylindrical form and the ends of the electroconductive elastic layer 3 are trimmed to a predetermined form, thereby completing a toner transfer roller according to the present invention.

Insofar as an image forming apparatus according to the present invention is equipped with the toner transfer roller according to the present invention, there is no particular restriction on another part of the constitution of the apparatus. By the image forming apparatus according to the present invention with the toner transfer roller according to the present invention, sufficient density can be secured at an initial stage of printing.

EXAMPLES

The present invention will be described in more detail by way of examples thereof.

A toner transfer roller configured with the electroconductive elastic layer 3 supported on the circumference of the shaft 1 by means of the adhesive layer 2 as shown in FIG. 1 was manufactured using the adhesive shown in the following Table 2 to form the adhesive layer. For the shaft 1, a metallic shaft (diameter ϕ 6 mm, length about 260 mm) was used. To prepare a source material for the electroconductive elastic layer 3, a pre-determined amount of a foam raw material mixture containing 100 parts by weight of a prepolymer prepared in advance by reacting a polyether polyol having a molecular weight of 5,000 with tolylene diisocyanate (TDI), 20 parts by weight of an aqueous carbon dispersion containing Ketchen black as an electroconductive additive dispersed in water as a foaming agent, 0.2 part by weight of tolylenediamine as a foaming catalyst, 0.2 part by weight of dipropylene diol as a curing catalyst, and 0.65 part by weight of a silicone as a foam stabilizer was cast in a block-form mold at a temperature of 50° C. and expanded, followed by heating for curing. The resulting block was then removed of excess water in a drying oven at 120° C. and cut to a pre-determined size, thereby completing an urethane foam as a source material.

The electroconductive elastic layer 3 prepared according to the above process was shaped and bored to form a hole corresponding to the shaft 1. A film of any one of the adhesives was formed on the circumference of the shaft 1 by winding a film-form adhesive or coating a molten pellet-form adhesive. Next, the shaft 1 was inserted in the hole of the electroconductive elastic layer 3, followed by heating at 130° C. for 60 min to consolidate the shaft 1 and the electroconductive elastic layer 3 by means of the adhesive layer 2. The surface of the electroconductive elastic layer 3 was ground to a cylindrical form with the outer diameter of 13 mm, and the ends of the electroconductive elastic layer 3 were trimmed to the length of about 218 mm, thereby completing each sample roller.

TABLE 2

| | Conventional example | Examples 1 to 3 |
|---|---|---|
| Manufacturer | Daicel Finechem Ltd. | Nihon Matai Co., Ltd. |
| Grade | Thermolite #6501 | Elphan UH203 |
| Material | Polyurethane base | Polyurethane base (Adipate base) |
| Melting point (° C.)*[1] | 105-110 | 150-200 |
| Form | Film | Film |

*[1]Measured by a Koka type (capillary) flow tester (by Shimadzu Corporation)

<Measuring Method for Roller Resistance>

Figure 2:
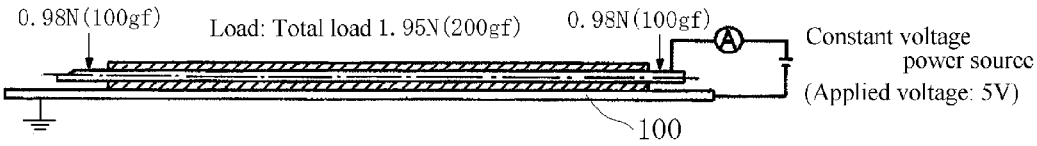
FIG. 2 is a schematic diagram of a resistance measuring device described in Examples.

The roller resistance of each prepared sample roller was measured by an apparatus shown in FIG. 2 in an environment of constant temperature and humidity (22.5° C. and 55 RH %). More specifically, each roller was placed on the metal plate 100 and, applying a load of 0.98 N on each end of the roller (total load: 1.96 N), a voltage of 5 V was applied by a voltage power source to measure the roller resistance. The measurement was conducted at a single point. The measurement was similarly conducted at an applied voltage of 100 V.

<Image Density Test>

Each sample roller was installed in a commercial LBP as a toner transfer roller. A pre-determined pattern was printed on a sheet of printing paper in an environment of constant temperature and humidity (22.5° C. and 55 RH %). The used cartridges were from the same production lot. The transmission density of the image appeared on the third printed sheet was measured. The transmission density was measured using X-Rite 310T manufactured by Sakata Inx Eng. Co., Ltd. for 5 solid black areas (density 100%) in the pattern. The average values of the transmission density at the respective areas were averaged again.

Figure 3:
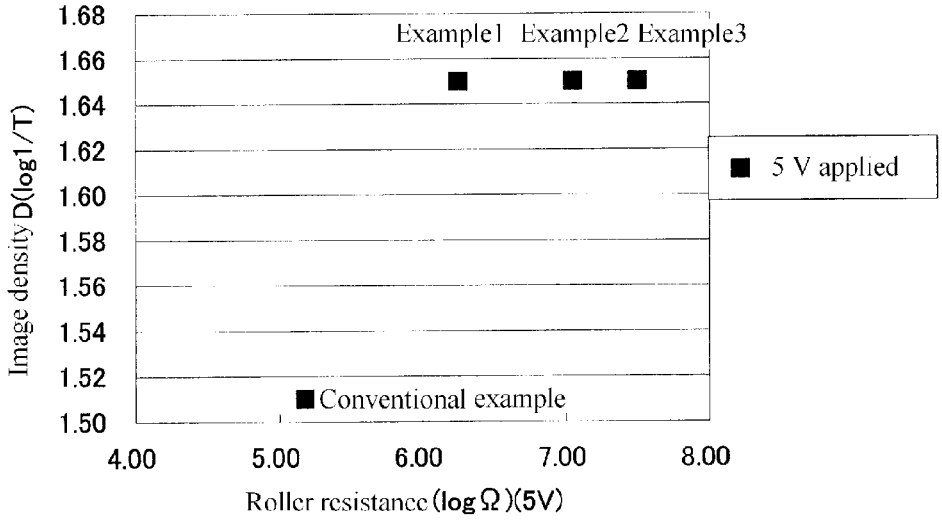
FIG. 3 is a graph describing a relationship between a roller resistance and an image density in Examples.
Figure 4:
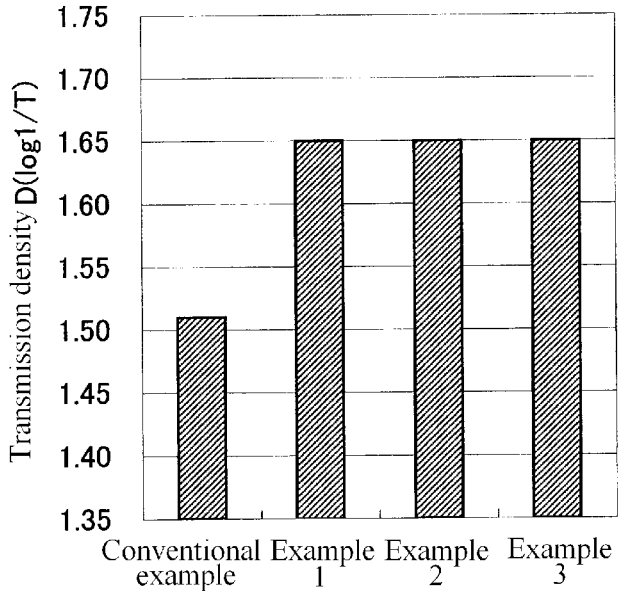
FIG. 4 is a graph describing an image density in Examples.
Figure 5:
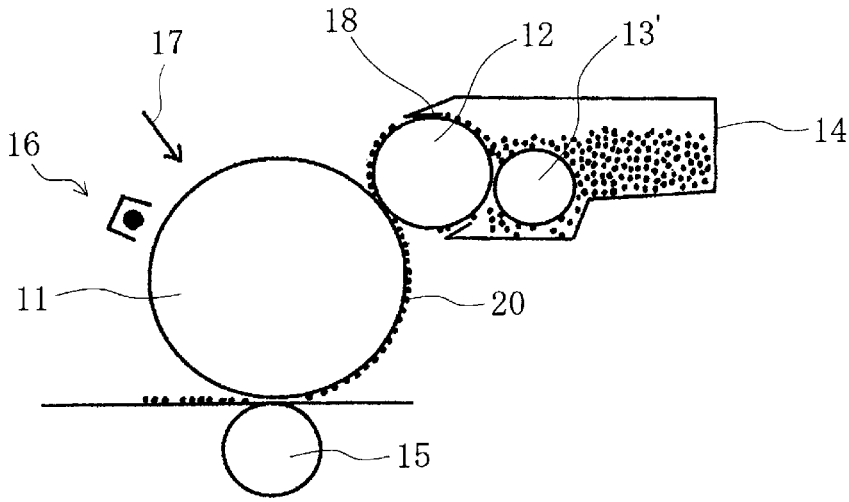
FIG.5 PRIOR ART
FIG. 5 is a schematic diagram of a related art example of an image forming apparatus.
Figure 6:
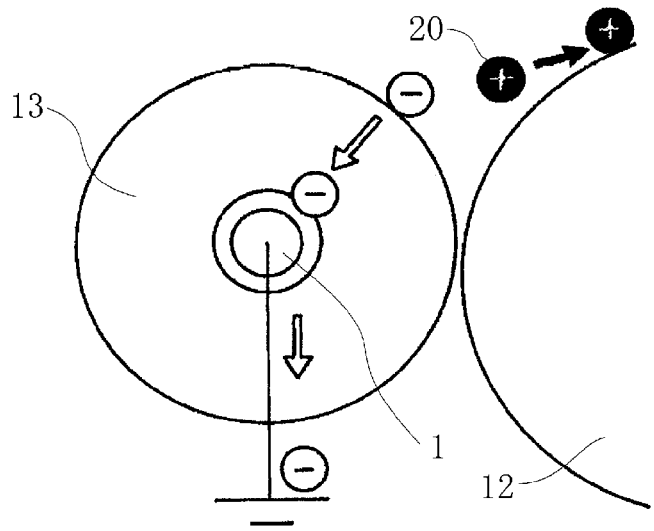
FIG. 6 is a schematic diagram describing a mechanism for transferring a toner from a toner transfer roller to a developing roller.
Figure 7:
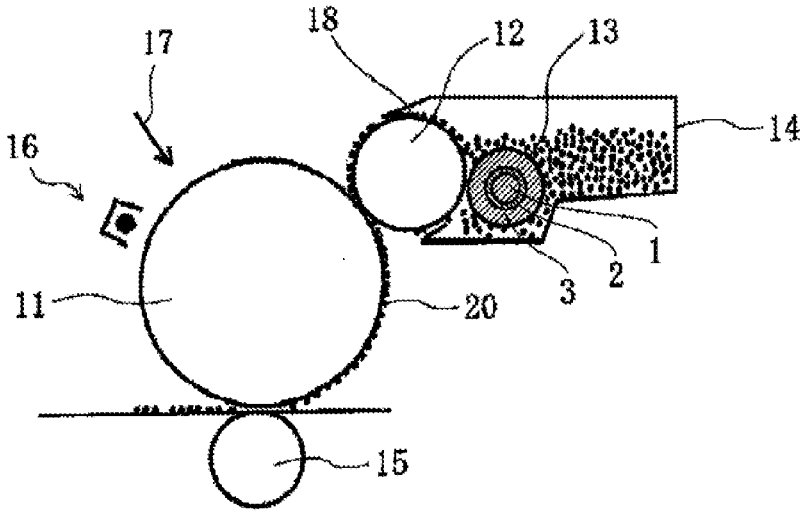
FIG. 7 is a schematic drawing of an image forming apparatus in one embodiment of the invention.

The results are shown in the following Table 3 and the graphs in FIGS. 3 and 4.

TABLE 3

| | | Conventional example | Example 1 | Example 2 | Example 3 |
|---|---|---|---|---|---|
| Adhesive | Material | Polyurethane base | Polyurethane base (Adipate base) | Polyurethane base (Adipate base) | Polyurethane base (Adipate base) |
| | Thickness (μm) | 100 | 100 | 50 | 200 |
| Melting point (° C.) | | 105-110 | 150-200 | 150-200 | 150-200 |
| Heating temperature (° C.) | | 130 | 130 | 130 | 130 |
| Melt status | | Molten | Semi-molten | Semi-molten | Semi-molten |
| Roller resistance (Ω) | Applied voltage 5 V | $10^{5.18}$ | $10^{7.05}$ | $10^{6.25}$ | $10^{7.50}$ |
| | Applied voltage 100 V | $10^{4.24}$ | $10^{4.15}$ | $10^{4.26}$ | $10^{4.20}$ |
| Image transmission density at initial printing stage D (log1/T) | | 1.51 | 1.65 | 1.65 | 1.65 |

Table 3, etc. confirmed that, in Examples, where a high melting point adhesive according to the present invention was used, a higher roller resistance was obtained in comparison to a conventional example, where a low melting point adhesive was used, and sufficient image density could be secured even at an initial stage of printing.

The invention claimed is:

1. A toner supply and cleaning roller comprising, a shaft and an electroconductive elastic layer made of a urethane foam and supported on the circumference of the shaft by means of an adhesive layer in between, wherein the resistance of the roller at an applied voltage of 100 V is $10^5\Omega$ or lower and the resistance of the roller at an applied voltage of 5 V is $10^6$ to $10^8\Omega$.

2. The toner supply and cleaning roller according to claim 1, wherein the adhesive layer comprises a hot-melting polymeric adhesive and is formed at a temperature not exceeding the melting point of the hot-melting polymeric adhesive.

3. The toner supply and cleaning roller according to claim 2, wherein the hot-melting polymeric adhesive comprises as a main component an adipate based polyurethane resin with the melting point of 120° C. or higher.

4. An image forming apparatus equipped with the toner supply and cleaning roller according to claim 3.

5. An image forming apparatus equipped with the toner supply and cleaning roller according to claim 2.

6. An image forming apparatus equipped with the toner supply and cleaning roller according to claim 1.

* * * * *